United States Patent [19]

Schueler et al.

[11] 3,981,285

[45] Sept. 21, 1976

[54] FUEL CONTROL SYSTEM FOR SUPERCHARGED, FUEL INJECTED INTERNAL COMBUSTION ENGINES

[75] Inventors: Peter Schueler, Asperg; Detlev Runge; Heinz Kuschmierz, both of Gerlingen, all of Germany

[73] Assignee: Robert Bosch G.m.b.H., Stuttgart, Germany

[22] Filed: June 19, 1975

[21] Appl. No.: 588,132

Related U.S. Application Data

[63] Continuation of Ser. No. 388,935, Aug. 16, 1973, abandoned.

[30] Foreign Application Priority Data

Aug. 19, 1972 Germany ..... 2240947

[52] U.S. Cl. ..... 123/119 C; 60/601; 123/140 MP

[51] Int. Cl.[2] ..... F02B 33/00

[58] Field of Search ..... 123/119 C, 119 CE; 60/598, 601, 603; 123/140 MP, 140 MC, 140 R

[56] References Cited

UNITED STATES PATENTS

| | | | |
|---|---|---|---|
| 1,955,037 | 4/1934 | Viel | 123/119 C |
| 2,295,656 | 9/1942 | Hersey et al. | 123/119 C |
| 2,390,166 | 12/1945 | Parkins et al. | 123/119 C |
| 2,562,656 | 7/1951 | Blakeslee | 123/140 MP |
| 2,589,788 | 3/1952 | Fell | 123/140 MC |
| 2,796,055 | 6/1957 | Cornelius | 123/140 MC |
| 2,841,130 | 7/1958 | Reggio | 123/119 CE |
| 2,895,465 | 7/1959 | Humber et al. | 123/140 R |
| 2,977,949 | 4/1961 | Barfod | 123/140 MP |
| 3,020,776 | 2/1962 | May et al. | 123/140 MC |
| 3,060,636 | 11/1962 | Dahl | 123/140 MP |
| 3,102,152 | 8/1963 | Schneider | 123/139 AW |
| 3,133,555 | 5/1964 | Powell et al. | 123/119 C |
| 3,354,874 | 11/1967 | Dangauthier | 123/140 MP |
| 3,566,847 | 3/1971 | Scholl et al. | 123/140 MC |
| 3,795,233 | 3/1974 | Crews et al. | 123/140 R |

FOREIGN PATENTS OR APPLICATIONS

| | | | |
|---|---|---|---|
| 1,158,318 | 11/1963 | Germany | 123/140 |

*Primary Examiner*—Charles J. Myhre
*Assistant Examiner*—Paul Devinsky
*Attorney, Agent, or Firm*—Edwin E. Greigg

[57] ABSTRACT

A fuel control system to provide an excess fuel quantity during engine acceleration and including manifold pressure actuated control units. The pressure increase in one control unit is delayed by throttling, resulting in net differential control forces tending to increase the fuel supplied to the injection nozzles of the engine injection system while the manifold pressure is rising.

16 Claims, 7 Drawing Figures

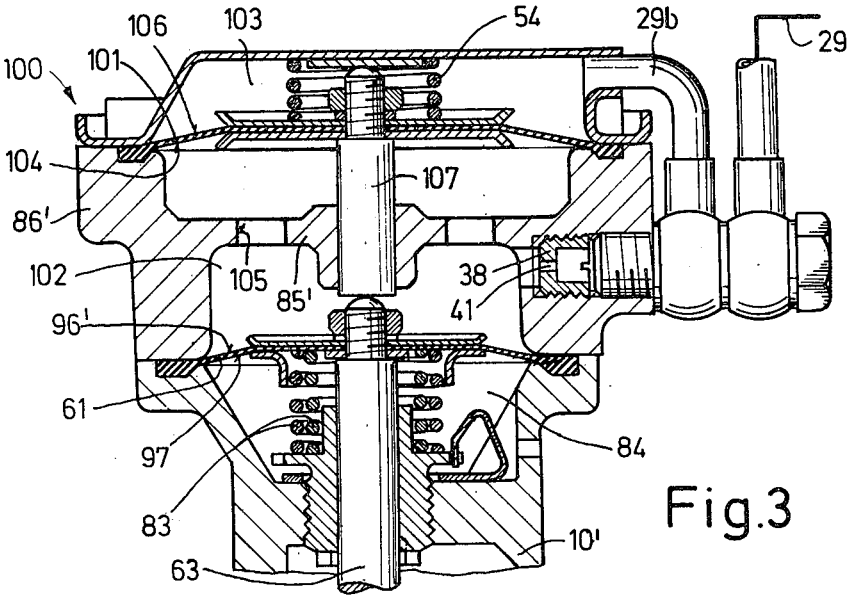
Fig.3
Fig.4
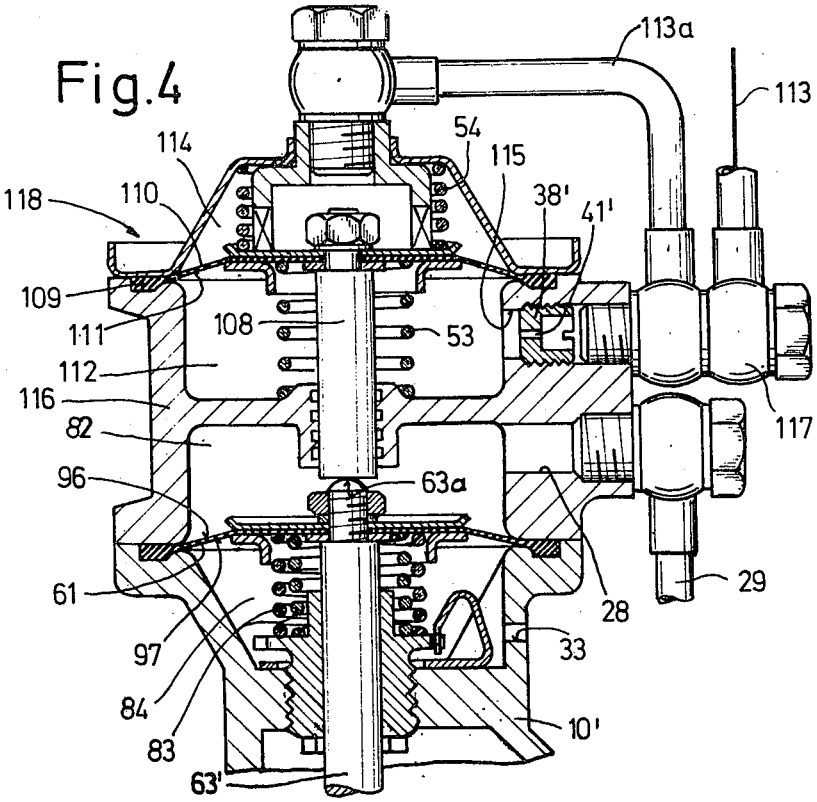

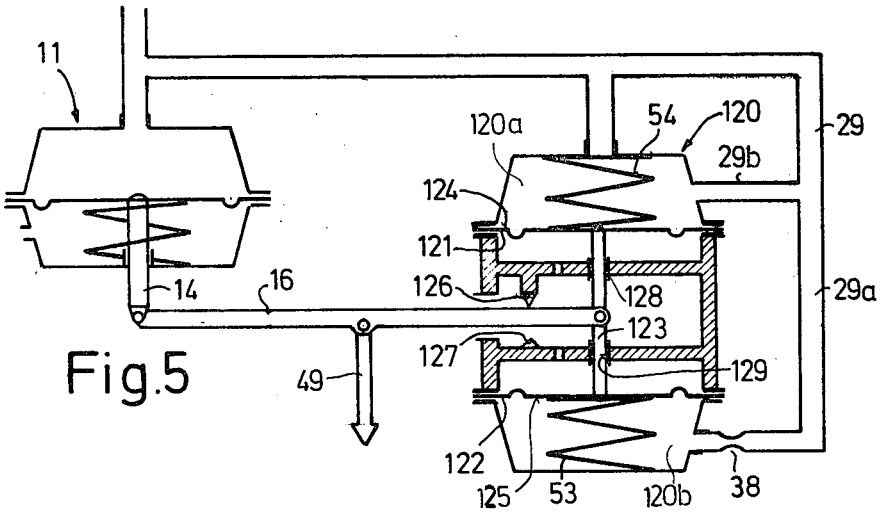
Fig.5
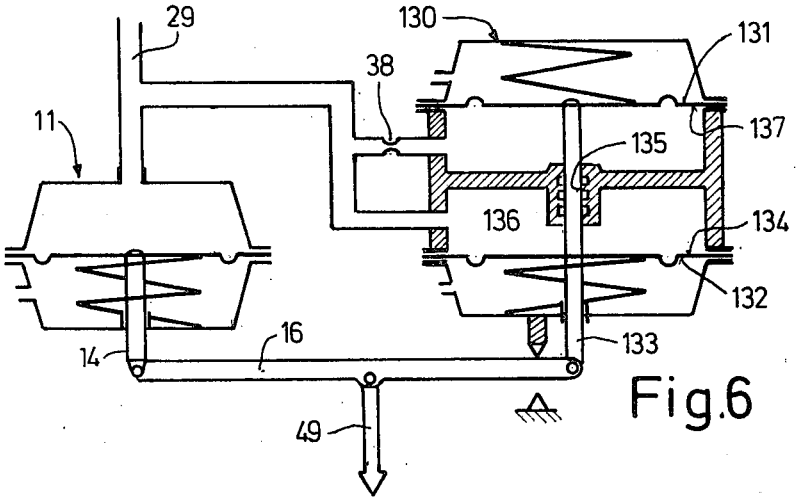
Fig.6
Fig.7
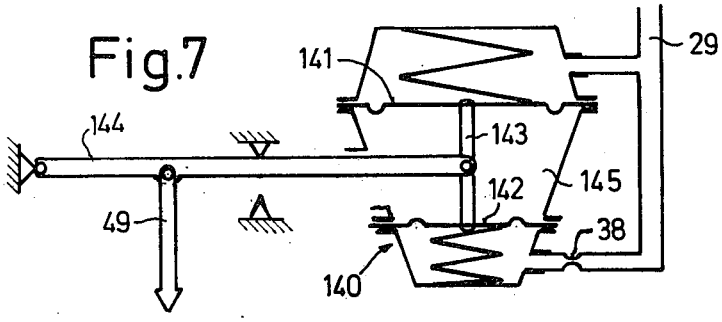

FUEL CONTROL SYSTEM FOR SUPERCHARGED, FUEL INJECTED INTERNAL COMBUSTION ENGINES

This is a continuation of application Ser. No. 398,935 filed Aug. 16, 1973, and now abandoned.

BACKGROUND OF THE INVENTION

1. Field of the Invention

The present invention relates to a fuel control system for supercharged, fuel injected internal combustion engines, in particular diesel engines employing exaust gas turbo-chargers. The individual control units of the control system each comprise a movable partition which is displaceable against the force of at least one return spring in dependence on the intake air pressure of the engine. The movable partitions are connected to a setting member by means of which the operating region of a supply quantity adjustment member of the engine injection system is changeable in the direction of increasing supply quantity during a period of increasing intake manifold air pressure.

2. Description of the Prior Art

Known control systems of the above-mentioned construction which are also designated as manifold pressure dependent full load stops or smoke limiters, are installed either at the injection pump or at the corresponding regulator of the engine, and their setting member influences either the position of a full load stop for the limitation of the control rod path or it limits the maximum excursion of the adjustment lever of the regulator attached to the injection pump, or again, it interacts with the control linkage in such a way as to change the position of the control rod of the injection pump from that which may have been set by the regulator to a new position lying further in the direction of increasing supply quantity, the magnitude of the change depending on the magnitude of the intake manifold air pressure. These known control systems have the disadvantage that the controlled increase of the fuel quantity during acceleration of the engine occurs with a time delay, because the manifold air pressure is used to measure the fuel increase and, in engines employing exhaust gas turbo-chargers, the manifold air pressure increases only after an increase of the exhaust gas pressure and of the exhaust gas temperature. This mutual dependence of fuel quantity, intake manifold pressure and exhaust gas pressure determines the acceleration characteristics of an engine equipped with an exhaust gas turbo-charger and employing the known control system. These acceleration characteristics are often incapable of meeting the demands made especially on modern vehicular diesel engines.

In order to achieve a more rapid acceleration of the engine, it would be possible, in principle, to increase the fuel quantity metered by the control system so that the desired acceleration of the engine would be achieved. This method has the considerable disadvantage, however, that during full load operation and during constant speed operation, the engine then develops inadmissible amounts of smoke.

OBJECTS AND SUMMARY OF THE INVENTION

It is an object of the present invention to avoid the above-mentioned disadvantages inherent in a control system of the above-mentioned construction and to improve this system in such a way that during the acceleration of the engine, a higher than normal fuel quantity is metered but that this increase can be regulated away, i.e. it is cancelled during the constant speed operation of the engine.

It is a more specific object of the present invention to provide a control system including a supplementary control unit having a flow-restricting delay member, the supplementary control unit imparting an additional displacement to a fuel control setting member.

These and other objects of the present invention are attained in that the position of the setting member is made to be additionally changeable by means of a supplementary second pneumatic control unit having delayed feedback characteristics and employing a second movable partition which is acted on by a differential pressure of a pneumatic control medium, the pressure being a measure of the acceleration of the engine. During a period of increasing pressure of the control medium, the setting member tends to be displaced, in the direction of increasing fuel supply quantity, beyond the position that was set by the first movable partition, and during a constant speed operation, this position change is reversible to a zero value by the effect of an increasing counter pressure exerted by the control medium and delayed by the action of a delay member. In this way, the so-called "lag" of the manifold pressure can be compensated for simply and advantageously without also increasing the normal fuel injection quantity which properly corresponds to a given manifold air pressure, during periods of constant speed operation of the engine.

A particularly advantageous embodiment of the present invention is achieved by letting the air in the intake manifold serve as the control medium and by using the instantaneous difference between the intake manifold air pressure which increases during acceleration of the engine and the counter air pressure which increases at a lower rate due to a delay member, to define the magnitude of the differential pressure. In this way, the expense of a second pressure source is avoided and the conduits are simplified. This does not exclude the possibility of using other pneumatic control media, especially for particularly precise control of the supplementary control unit, and this can be, for example, an rpm-dependently increasing air pressure.

In the subsequent description, the symbol $P_L$ will designate the instantaneous value of the full intake manifold air pressure and the symbol $P_{LV}$ will designate the instantaneous value of the pressure prevailing downstream of a delay member which contains a flow throttle and is connected to the intake manifold.

During increases of $P_L$, $P_{LV}$ also increases, but at a lower rate, due to the presence of the delay member. Thus during increases of $P_L$, the instantaneous values of $P_{LV}$ are always lower than those of $P_L$, i.e. $P_{LV}$ lags behind $P_L$ or it is "delayed".

Similarly, $P_{AB}$ will designate the full exhaust gas pressure and $P_{AV}$ will designate the delayed exhaust gas counter pressure.

The symbol $P_{AT}$ will designate the ambient or atmospheric air pressure.

A simple and neat contruction of the supplementary control unit derives from letting only the second movable partition effect the supplementary position change of the setting member and from providing that the primary pressure side of the partition is acted on by the full manifold air pressure $P_L$, and that the counter pressure side is acted upon by the delayed increasing manifold air counter pressure $P_{LV}$, delayed by the delay member.

Furthermore, it is advantageous that the movable partitions are two diaphragms which are fastened to connecting rods pivotably attached to the two ends of a two-armed lever, whose center is pivotably connected to the setting member. The two lever arms transmit the travel of both diaphragms in diminishing ratio to the setting member; the independently carried out setting of the two diaphragms and of the two lever arms makes possible a very precise adaptation of the control system to the prescribed control motions.

It is advantageous to make the pre-tension of the return spring which loads the first diaphragm changeable by means of an adjustable support bushing which is screwed into the housing of the control system and which also serves as a guide sleeve for the connecting rod of the first diaphragm.

A further advantageous embodiment of the present invention is that the movable partitions are formed by two coaxial and sequentially disposed diaphragms, of which the first diaphragm is fixedly connected with the setting member and the second diaphragm acts through a connecting rod on the setting member, so that very few moving parts are present.

In order that the forces exerted by both diaphragms be additive, an advantageous embodiment of the invention is characterized in that the two diaphragms define and separate four chambers, of which the two chambers which are contiguous to the primary pressure sides of the two diaphragms are acted upon by the full manifold air pressure $P_L$, the chamber which is contiguous to the counter pressure side of the first diaphragm is acted upon by ambient air pressure $P_{AT}$, and the chamber contiguous to the counter pressure side of the second diaphragm is acted upon by the increasing manifold air counter pressure $P_{LV}$, delayed by the delay member.

Another advantageous embodiment of the present invention is provided in that the second diaphragm is made larger than the first diaphragm and that these two diaphragms separate three chambers from one another, of which the chamber contiguous to the primary pressure side of the second diaphragm experiences the full manifold air pressure $P_L$, the middle chamber which is contiguous simultaneously to the counter pressure side of the second diaphragms and the pressure side of the first diaphragm is acted upon by the delayed increasing manifold air counter pressure $P_{LV}$, and the chamber which is contiguous to the counter pressure side of the first diaphragm is acted upon by ambient air pressure. This advantageous arrangement of both diaphragms requires only a small construction space and, during a constant speed operation of the engine, substantially only the area of the smaller diaphragm is effective.

Because the increase of the exhaust gas pressure with rpm occurs faster that that of the manifold air pressure, a further advantageous embodiment of the present invention is achieved when the control medium is exhaust gas and the second movable partition is affected by the full exhaust gas pressure $P_{AB}$ acting on its primary pressure side for effecting the supplementary position change of the setting member, whereas the counter pressure side of the partition is acted upon by the delayed increasing exhaust gas counter pressure $P_{AV}$, delayed by the delay member.

A simple influence on the feedback time constant is achieved in that the delay member contains, in a known manner, a flow throttle which is inserted in a supply channel leading to the chamber contiguous to the counter pressure side of the second movable partition. Furthermore, it is provided that, parallel to the flow throttle, a check valve is so disposed that it makes possible an unthrottled return flow of the control medium from the chamber contiguous to the counter pressure side of the second movable partition by which means a rapid adaptation of the control system to the decreasing pressure of the control medium is possible during deceleration of the engine.

In order to influence the response threshold and the control characteristics of the supplementary control unit, an advantageous embodiment of the present invention is that the counter pressure side of the second movable partition is loaded by the return spring, and its pressure side is loaded by an equalization spring whose pre-tension acts in opposition to the pre-tension of the return spring.

In order to guarantee a reliable operation of the control unit for any value of the pressure of the control medium, it is provided in a further advantageous development of the present invention that the second movable partition comprises two coaxial, sequentially disposed diaphragms of equal size, which are connected by a connecting rod which in turn is pivotably connected to the setting member, and where the primary pressure side of one diaphragm experiences the full manifold air pressure, and the corresponding primary pressure side of the other diaphragm acts as the counterpressure side of the second movable partition and experience the delayed increasing manifold air counter pressure. In this way the influence of the connecting rod on the pressure-related forces acting on the diaphragm is eliminated.

In order to eliminate the influence of the connecting rod on the forces acting on the diaphragm and at the same time to avoid using guide bushings which must be sealed against the manifold pressure, a further advantageous development of the present invention is achieved by having two coaxial, sequentially disposed and oppositely acting diaphragms of different diameter serve as the movable partitions. They are connected with one another by a connecting rod which further attaches to the setting member and the larger of the two diaphragms is exposed to the full manifold air pressure whereas the smaller of the two diaphragms is exposed to the delayed increasing manifold air counter pressure so that, during constant rpm of the engine, only the differential area of the two diaphragms is effective; the space surrounding the connecting rod and lying between the two diaphragms being exposed to ambient air pressure.

BRIEF DESCRIPTION OF THE DRAWING

In the drawing, seven exemplary embodiments of the control system according to the present invention are illustrated and are described further below.

FIG. 3 is a partial cross sectional view illustrating a third exemplary embodiment according to the present invention;

FIG. 4 is a partial cross sectional view illustrating a fourth exemplary embodiment according to the present invention;

FIGS. 5 – 7 are more schematic illustrations of three additional exemplary embodiments according to the present invention.

DESCRIPTION OF THE PREFERRED EMBODIMENTS

Figure 1:
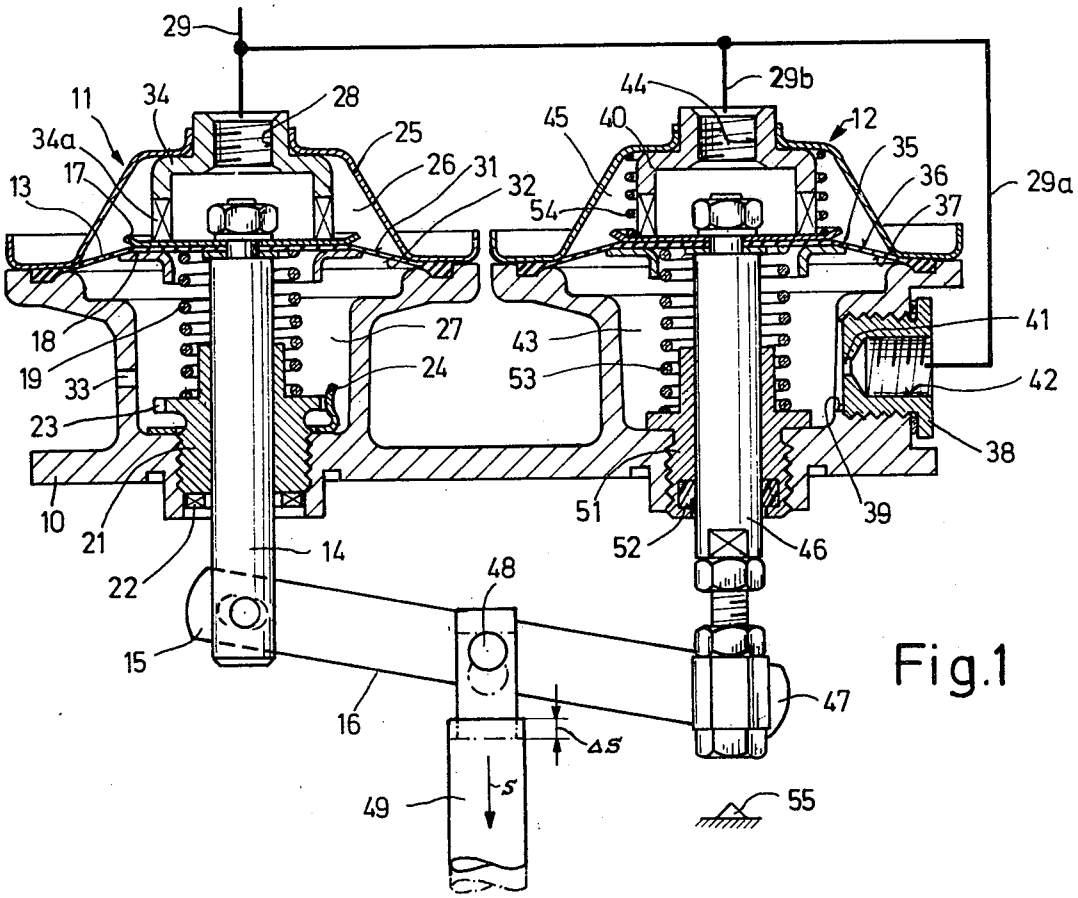
FIG. 1 is a partial cross sectional view in elevation illustrating one exemplary embodiment of the control system according to the present invention including details of a first and supplementary control units.

Turning now to the first exemplary embodiment illustrated in FIG. 1, there is shown a housing 10, in which two control units 11 and 12 are disposed parallel to each other. The first control unit 11 incorporates a movable partition in the form of a diaphragm 13 which is fixedly attached to one end of a connecting rod 14 whose other end is pivotably fastened to an end 15 of a two-armed lever 16. The center of the diaphragm 13, which is attached to the connecting rod 14, is fixed between two discs 17 and 18. The disc 18 serves also as a spring support for a return spring 19 which loads the diaphragm 13. The end of the spring 19 which faces away from the disc 18 bears on an adjustable support bushing 21 that is screwed into the housing 10 of the installation. The bushing 21 is rotatable by means of a tool inserted into depressions 22 for the purpose of changing the pre-tension Pvl of the return spring 19. The adjustable support bushing 21 also serves as a guide bushing for the connecting rod 14 and has a serrated edge 23, which engages a detent spring 24 for securing a rotation position of the bushing 21.

In a known manner the diaphragm 13 is hermetically joined to the housing 10 by a cover 25 and separates two chambers 26 and 27 from one another. The chamber 26 communicates through a connecting bore 28 with an intake manifold air line 29 which is shown only schematically. The intake manifold air is admitted to the chamber 26 through the intake air line 29 and acts on one side of the diaphragm 13 which is designated 31. The pressure $P_L$ of the intake air serves as the pneumatic control medium. The side designated 32 will be referred to as the counter pressure side. The side 32 seals off the chamber 27 from the chamber 26 and is itself acted on by an ambient air pressure $P_{AT}$, since the chamber 27 always has an open communication to the outside through a bore 33. The drawn rest position of the diaphragm 13 is determined firstly by the pre-tension of the return spring 19 and secondly, by a fixed stop, consisting of a cylindrical cap 34. The cap 34 is fixedly attached to the cover 25 and contains the connecting bore 28. The cap 34 is also provided with slots **34*a* through which intake manifold air streaming through the connection bore 28 can flow into that part of the chamber 26 that lies outside of the cap 34 when the disc 17 abuts the cap 34**.

Control unit 11 operates in a known manner in dependence on the intake manifold air pressure of the engine, and parallel to this control unit 11 there is disposed the second control unit 12 which employs a second movable partition in the form of a diaphragm 35. On one side, designated 36, of the diaphragm 35, there acts the full manifold air pressure $P_L$ which is communicated through a branch line **29*b*. On the counter pressure side, designated 37, there acts a delayed increasing air counter pressure $P_{LV}$. The counter pressure $P_{LV}$ builds up with a delay due to a delay element 38. The delay element 38 consists of a threaded insert which is screwed into a threaded bore 39 in the wall of the housing 10, and which serves as a supply channel containing a flow throttle 41 formed as a narrow bore. The threaded insert 38, in addition to the flow throttle, 41, also contains a connecting thread 42 to which a branch line 29*a* of the manifold air line 29 is connected. The diaphragm 35 divides the interior of the control unit 12 into chambers 43 and 45. The counter pressure side 37 is acted upon by the intake manifold pressure $P_{LV}$ as a result of intake manifold air streaming through the flow throttle 41 and into the chamber 43, whereas the primary pressure side 36 is acted upon by manifold air pressure $P_L$, which streams without throttling through a connecting bore 44 into the chamber 45. The shown rest position of the diaphragm 35 is determined, in the same way as in the first control unit 11, by a cap 40** serving as a stop.

Diaphragm 35 serving as the second movable partition similar to the first diaphragm 13, is attached to a connecting rod 46 whose one end is pivotably fastened to an end 47 of the two-armed lever 16. The lever 16 has a central pivot which is formed by a bolt 48 which pivotably connects lever 16 to a setting member 49. The connecting rod 46 is guided in a guide bushing 51. The bushing 51 is provided with a packing 52 that seals off the chamber 43 from the outside.

As with the first movable partition 13, the second movable partition 35 is loaded on its counter pressure side 37 by a return spring 53, which is opposed on the primary pressure side 36 by a compensating spring 54. The pre-tension Pv3 of the spring 54 acts in opposition to the pre-tension Pv2 of the return spring 53. The oppositely acting compensating spring 54 permits a very exact setting of the response threshold of the second control unit 12. The return spring 53 determines the characteristics of the second control unit, which operates as a supplementary control unit with delayed feedback in the manner of a pneumatic differentiating unit. The cooperation of the two control units will be described more fully below.

Figure 2:
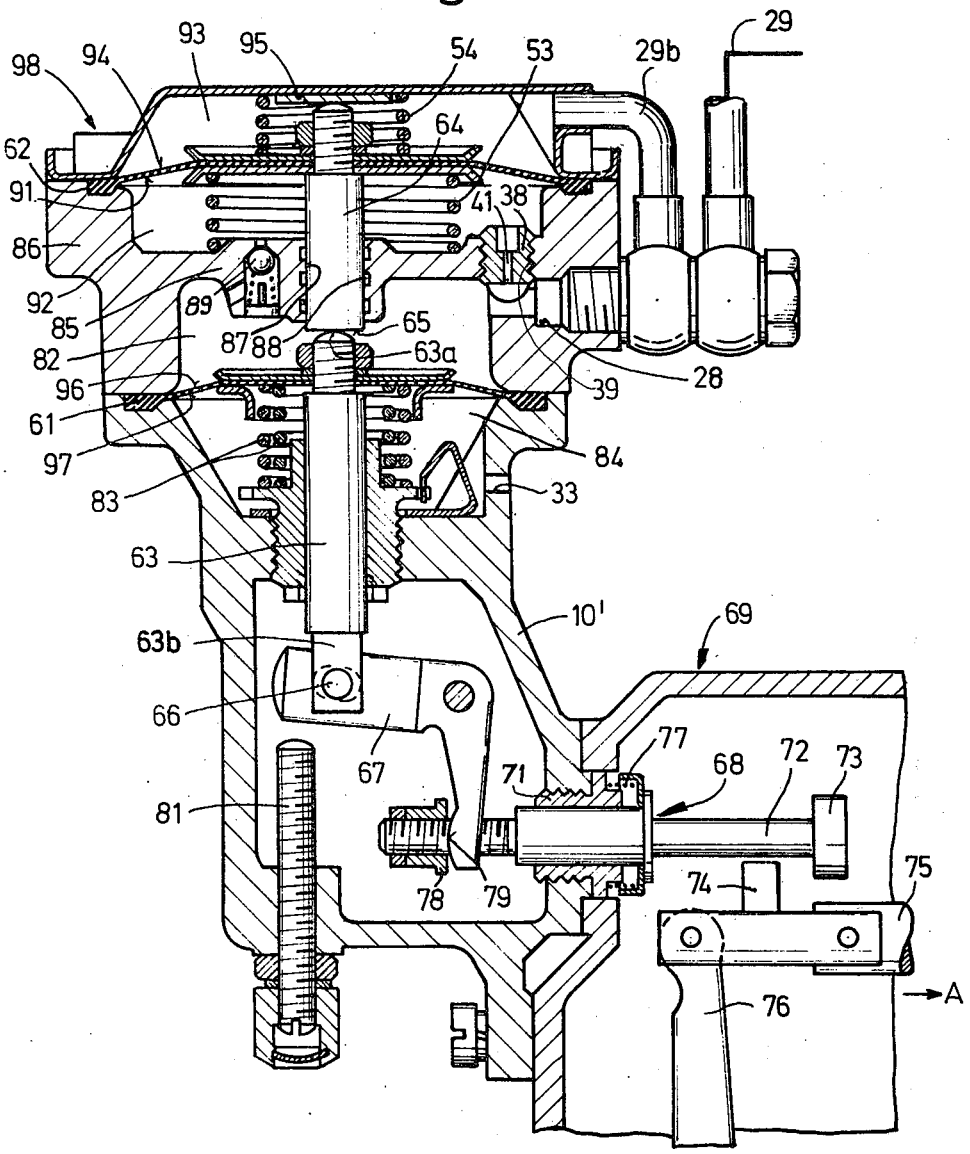
FIG. 2 is a partial cross sectional view in elevation illustrating a second exemplary embodiment of the control system according to the present invention.

The setting member 49, in a known manner not shown in FIG. 1, acts upon the operating region of a supply quantity adjustment member belonging to the injection system of a diesel engine equipped with an exhaust gas turbo-charger. In FIG. 2 there is exemplarily shown an embodiment in which the setting member limits the motion of a stop mounted on a centrifugal rpm regulator for the limitation of the maximum full load position of a control rod serving as a supply quantity setting member in an injection pump.

This second exemplary embodiment shown in FIG. 2 differs from the first exemplary embodiment of FIG. 1 especially in that the movable partitions are embodied as two coaxial and serially disposed diaphragms 61 and 62. The first diaphragm 61 is fixedly attached to a connecting rod 63, which serves as a setting member. The second diaphragm 62 actuates another connecting rod 64, whose one end 65 presses against one end **63*a* of the connecting rod 63. The other end 63*b* of the connecting rod 63 is developed as a fork and, through the intermediate action of a bolt 66, actuates an angled lever 57 mounted within the housing 10' of the control unit. The angled lever 57, in turn, limits the position of a full load stop 68 which forms part of a centrifugal rpm regulator 69 (only partly shown). The full load stop 68 consists of a limit bolt 72 guided in a guiding bushing 71. The bolt 72 has a head 73 which serves as an abutment for the nose 74. The nose 74 abuts the head 73 in a known manner whenever the control rod 75, serving as the supply quantity setting member of the injection pump not further shown, is moved by a control lever 76, of the centrifugal rpm regulator 69, in the direction of arrow A for the purpose of regulating a maximum quantity of injection fuel. The limit bolt 72 is held in its shown position by a spring 77, and, in this position, a stop nut 78 engages a butting surface 79 of the angled lever 67. An abutment screw 81 limits the path of the angled lever 67 and therefore also limits the maximum position change ($\Delta s$ max) of the setting member 63** which may be regulated by the control unit in dependence on the intake manifold air pressure $P_L$.

The diaphragm 61 separates a chamber 82 lying above this diaphragm from a chamber 84 which houses two return springs 83 and which is open to the ambient air pressure $P_{AT}$ through a bore 33. The chamber 82 communicates through the connection bore 28 with the intake air line 29, and therefore receives the full intake manifold air pressure $P_L$. An intermediary wall 85 belonging to a second housing 86 contains a guide bore 87 to receive connecting rod 64 of the second diaphragm 62 and includes a labyrinth seal 88. This intermediary wall 85 also contains the delay element 38 which is inserted into the threaded bore 39. The delay element 38 includes the flow throttle 41. The intermediary wall 85 further contains a check valve 89 lying parallel to the delay member 38.

The second diaphragm 62 separates a chamber 92, defined by the intermediate wall 85 and by the counter pressure side 91 of the diaphragm 62, from another chamber 93 to which the full intake air pressure $P_L$ occurring in the intake manifold pressure line 29 is communicated through the branch line **29*b*. The primary pressure side 94 of the diaphragm 62 is acted upon by the full manifold pressure $P_L$, whereas the counter-pressure side 91 of this diaphragm 62 experiences the counter pressure $P_{LV}$ whose increase is delayed by the delay member 38. As was the case with the diaphragm 35 in FIG. 1, the diaphragm 62 is tensioned between two springs 53 and 54, and the shown rest position is determined by an abutment plate 95. The primary pressure side 96 of the first diaphragm 61 experiences the manifold air pressure $P_L$, and the counter pressure side 97 experiences the ambient air pressure $P_{AT}$. In this construction of the control system, the supplementary control unit 98 is equipped with a second diaphragm 62 and operates both against the force of the return spring 53 as well as against the force of the return springs 83 of the first diaphragm 61. In addition, the check valve 89 makes possible a pressure equalization between the chamber 92 and the chamber 82 in the even of rapid pressure variations. If the control characteristics permit it, the return spring 53 can be omitted, and the return force can be provided by only springs 83**.

The control system according to the third exemplary embodiment shown in FIG. 3, includes a supplementary control unit 100 which has a diaphragm 101. And just as the second exemplary embodiment of FIG. 2, the embodiment of FIG. 3 has two coaxial and sequentially disposed diaphragms 61 and 101, which however, in contrast to the two diaphragms 61 and 62 of the second exemplary embodiment of FIG. 2, separate from one another only three chambers 84, 102 and 103. The first diaphragm 61 and the only partially shown housing 10' correspond to those already shown in FIG. 2 and are therefore designated in the same way. As in the second exemplary embodiment of FIG. 2, the chamber 84 and therefore the counter pressure side 97 of the first diaphragm 61 in FIG. 3 experience the ambient pressure $P_{AT}$, whereas the side 96' of the first diaphragm 61 experiences the delayed counter pressure $P_{LV}$ prevailing in the chamber 102 and communicated to it through the delay member 38. This pressure acts also upon the counter pressure side 104 of the second diaphragm 101, because the chamber 102 occupies the entire space between the two diaphragms 61 and 101 by reason of the openings 105 located in the intermediary wall 85' of a second housing 86'. The chamber 103 communicates with the intake manifold air line 29 through branch line **29*b* so that the entire manifold air pressure $P_L$ prevails in it and acts upon a primary pressure side 106 of the second diaphragm 101**.

In this exemplary embodiment, the second diaphragm 101 must be larger than the first diaphragm 61, since, when the engine rpm is constant, and when the pressure in the chamber 103 is equal to the pressure in the chamber 102, only the smaller area of the diaphragm 61 is effective against the return force of the return springs 83; whereas during acceleration, the larger area of the diaphragm 101 is effective. The equalization spring 54, which is very weak and whose only purpose is to effect an abutment of a push rod 107 of the second diaphragm 101 to the setting member 63, is not opposed by a special return spring as is the case in the embodiment illustrated in FIG. 2. According to the embodiment of FIG. 3, springs 83 serve as the common return springs for both diaphragms 61 and 101. Of course, if the control characteristics require it, the second diaphragm 101 can be loaded directly by a return spring 53 as was done in the embodiment of FIG. 2.

The fourth exemplary embodiment depicted in FIG. 4 is constructed in a similar manner to that of the embodiment of FIG. 2 and those parts which are identical with the parts of FIG. 2, and whose operation is also the same, have been designated with the same reference numerals. The diaphragm 61 acting as the first movable partition and in the same way as in the second exemplary embodiment of FIG. 2, experiences the full manifold air pressure $P_L$ on its primary pressure side 96. The manifold air at pressure $P_L$ streams into the chamber 82 from the intake air line 29 through the connecting bore 28. The chamber 84, closed off by the counter pressure side 97 of the diaphragm 61, is acted upon by ambient air pressure $P_{AT}$ admitted through the bore 33 in the wall of the housing 10'. The connecting rod 63, which is fixedly attached to the membrane 61 and which serves as the setting member, abuts at its end **63*a* with a coaxial rod 108, which, in turn, is attached to a diaphragm 109 serving as a second movable partition. The diaphragm 109 has a primary pressure side 110 which experiences the full exhaust gas pressure $P_{AB}$ of the exhaust gases, which serve as a control medium and whose counter pressure side 111 experiences the exhaust gas counter pressure $P_{AV}$, which builds up at a rate which is delayed by a delay member 38'. The delay member 38' is provided with a flow throttle 41' for effecting this purpose. The exhaust gas flows in through the exhaust gas line 113, and is led through a branch line 113*a* into a chamber 114, contiguous to the primary pressure side 110 of diaphragm 109. The full exhaust gas pressure $P_{AB}$ is effective in chamber 114, whereas as has already been mentioned, a delayed rising exhaust gas counter pressure $P_{AV}$ prevails in a chamber 112 and acts upon the counter pressure side 111 of the diaphragm 109. The supply channel to the chamber 112 is formed by a connecting bore 115 disposed in the wall of a housing section 116. The housing section 116 also includes the delay element 38' as well as tube connectors 117 for the exhaust gas lines 113 and 113***a*. The diaphragm 109, together with the push rod 108 and the surrounding chambers 112 and 114 is a fundamental component of the supplementary control unit 118 which is acted upon by exhaust gas serving as the control medium.

The fifth exemplary embodiment, shown in FIG. 5 in a simplified form, corresponds in its basic contruction to the first exemplary embodiment of FIG. 1, and identical parts are therefore identically designated. In order to eliminate the influence of the connecting rod 46 in FIG. 1 on the forces exerted by the manifold air pressure $P_L$ on the second movable partition 35, the second control unit 120 of the exemplary embodiment of FIG. 5 incorporates as a second movable partition two equally large coaxial, sequentially disposed diaphragms 121 and 122 which are attached to the two ends of a connecting rod 123. The connecting rod 123 is in turn pivotably connected via a lever 16 to a setting member 49. The setting member 49 can also be acted upon by the control unit 11. The primary pressure side 124 of the diaphragm 121 experiences the full intake air pressure $P_L$ prevailing in the intake manifold line 29 and admitted to a chamber 120*a* through a branch line 29*b*. The corresponding, equally large primary pressure side 125 of the other diaphragm 122, which serves as the counter pressure side of the second movable partition, is acted upon by a rising manifold air counter pressure $P_{LV}$ in the chamber 120*b* which is delayed by the delay member 38. The effect of a return spring 53 is to influence the operation of the second movable partition 121, 122 and the threshold response of the second control unit 120 can be adjusted by means of a compensating spring 54 as was done with the control unit 12 in FIG. 1. Two stops, 126 and 127, limit the stroke of the connecting rod 123 and therefore limit the position change ($\Delta s$) of the setting member 49 that can be produced by the second control unit 120. This second control unit 120 which is equipped with the two diaphragms 121 and 122 also has the advantage that the connecting rod 123 exerts no influence on the pressure surfaces and has the further advantage that the sleeves 128 and 129 for the rod 123 do not have to be specially sealed since in all the spaces surrounding these sleeves, ambient air pressure prevails.

The sixth exemplary embodiment, shown in FIG. 6 in a simplified form, is similar in construction to the fifth exemplary embodiment shown in FIG. 5. The second control unit 130 acts on a lever 16 and therefore also on a setting member 49, this action being in addition to that of a first control unit 11. The second movable partition consists of two diaphragms 131 and 132, both of which are attached to a connecting rod 133 which in turn is connected via the lever 16 with the setting member 49. In contrast to the example of FIG. 5, the primary pressure sides designated 137 and 134 of the two diaphragms 131 and 132 are opposed to each other, with the primary pressure side 134 being acted upon by the full manifold air pressure $P_L$ admitted through a manifold pressure line 29, and with the primary pressure side 137 being acted on by the manifold air counter pressure $P_{LV}$, which is built up in a delayed manner by the member 38. The disposition of the diaphragms 131 and 132 according to FIG. 6 has the advantage over the disposition according to FIG. 5 of a constructionally more favorable placement at only one side of the lever 16, however, the guide sleeve 135 must be provided with a seal 136.

The seventh exemplary embodiment according to FIG. 7 employs a supplementary control unit 140 comprising two coaxial sequentially disposed and oppositely acting diaphragms 141 and 142 of different diameters. The diaphragms 141 and 142 are connected with one another by a rod 143, and are connected with the setting member 49 by a lever 144. The larger diaphragm 141 is exposed to the full manifold air pressure $P_L$ admitted through a manifold air line 29, while the smaller diaphragm 142 is exposed to the rising delayed counter pressure $P_{LV}$, which is delayed by a delay member 38 so that during constant rpm operation of the engine, only the differential surface area of the two diaphragms 141 and 142 is effective. A chamber 145 surrounding the rod 143 and lying between the two diaphragms 141 and 142 contains air at ambient pressure $P_{AT}$ so that this construction contains no guide sleeve which must be sealed against a higher pressure.

OPERATION OF THE VARIOUS EMBODIMENTS

The method of operation of the control system according to the present invention is described below where, in particular, the method of operation of the supplementary control units 12, 98, 100, 118, 120, 130 and 140 is explained.

In FIG. 1, both control units 11 and 12 are shown in their quiescent position determined by the return springs 19 and 53 and the stops 34 and 40. The control unit 11 acts in a known manner as an intake manifold pressure dependent stop which includes a chamber 26 within which manifold air at a pressure $P_L$ is admitted through the manifold pressure line 29. During periods of increasing manifold air pressure $P_L$ the connecting rod 14 is displaced downwardly by the diaphragm 13 corresponding to the force acting on the diaphragm 13 and in opposition to the return spring 19. During this displacement the lever 16 pivots on the bolt 48 and at the same time moves the setting member 49 in the direction indicated by the arrow *s*. The setting member 49, in a known and therefore not more explicitly represented manner, either may actuate a full load stop for the supply quantity setting member of an injection system neither of which is shown, or it may displace the pivotal point of an intermediate lever belonging to a centrifugal rpm governor (also not shown) in such a way that the entire control region is displaced in the direction of increasing supply quantity.

The supplementary control unit 12 and its chamber 45, like chamber 26, are exposed to the full manifold air pressure $P_L$ through the branch line 29*b;* whereas the second chamber 43 is acted upon by a rising manifold air counter pressure $P_{LV}$ which is developed as a result of the flow throttle 41 in the delay member 38. Hence the supplementary control unit 12 acts as a pneumatic differentiating element or as a control unit with a delayed feedback. During, for example engine acceleration and therefore increasing manifold air pressure $P_L$, a larger or smaller, depending on the magnitude of the acceleration, differential pressure $\Delta P$ ($\Delta P = P_L - P_{LV}$) acts upon the connecting rod 46 and displaces it downwardly. This causes the setting member 49 to be moved by the lever 16 also in the direction *s* beyond the position set by the first control unit 11 and in the direction of increasing supply quantity. The magnitude of the motion is designated in FIG. 1 by $\Delta s$; with the second position of the setting member 49 being shown in broken lines.

Only during constant speed operation of the engine, i.e. when the rpm no longer changes, ($n$ = const.), does the flow throttle 41 become ineffective and the same manifold air pressure $P_L$ prevails in the chamber 43 as well as in the chamber 45. Since no pressure difference $\Delta p$ is now present, the change of position $\Delta s$ which was produced by the secondary control unit 12 is restored to zero ($\Delta s = 0$), i.e. the connecting rod 46 and its diaphragm 35 return to their starting position, shown in FIG. 1. They are urged by the return spring 53 into their starting position in which position the diaphragm 35 abuts the cap stop 40. A stop 55, shown only schematically, limits the path of the rod 46 and therefore limits the maximum supplementary position change $\Delta s$ max provided for the setting member 49.

The design of the flow throttle 41 is such that during a slow intentional, operator controlled acceleration of the engine it is ineffective and therefore no effective differential pressure $\Delta p$ occurs at the supplementary control unit 12. The control unit 12 remains in the shown rest position and only the control unit 11, acting as a manifold pressure dependent stop is active.

By changing the throttle aperture of the flow throttle 41, and by changing the characteristics and pre-tension of the springs 53 and 54 as well as the adjustment of the stop 55 or perhaps by changing the surface area of the diaphragm 35, the supplementary control unit 12 can be adapted to produce any desired position change $\Delta s$ of the setting member 49.

In the second exemplary embodiment of FIG. 2, the supplementary control unit 98, as has been described above, is disposed at an extension of the axis of the connecting rod 63 and the force deriving from the differential pressure $\Delta P$, which is transmitted from the diaphragm 62 to the connecting rod 64, just as was the case in the control unit 12 of FIG. 1, is added to the force which is exerted, in dependence on the manifold pressure $P_L$, by the diaphragm 61 on the push rod 63 serving as a setting member. In this arrangement, the supplementary control unit 98 also becomes ineffective during constant rpm operation because the full manifold air pressure $P_L$ prevailing in the chamber 93 also builds up in the chamber 92 adjacent to the counter pressure side 91 of the diaphragm 62.

The check valve 89, disposed in the intermediate wall 85 of the housing section 86 permits equalization of the pressure between the chambers 92 and 82 during rapid pressure changes.

During constant speed operation or during very slow acceleration, no pressure difference $\Delta p$ exists across the membrane 62 and hence only the diaphragm 61 operates in dependence on the manifold pressure $P_L$ and, by means of angled lever 67, sets the full load stop 68 to the desired maximum fuel quantity to be provided. The set screw 81 limits the maximum possible adjustment path $\Delta s$ max of the lever 67. This is necessary because the highest fuel supply quantity metered by the control system corresponding to the maximum manifold pressure must not be exceeded even when a more rapid acceleration is desired, because of the smoke restrictions placed on the engine. The excess fuel quantity metered by the supplementary control unit 98, and which is intended to permit a more rapid acceleration of the engine and also to compensate for the so-called lagging of the supercharger, is therefore effective only in that region which lies between the two limiting positions of the full load stop 68. These two limiting positions are set by the stops 95 and 81 and the setting region can also be shifted in a parallel sense by rotation of the set nut 78.

In the third exemplary embodiment according to FIG. 3, the supplementary control unit 100 contains a second diaphragm 101. This second diaphragm 101 must be larger than the first diaphragm 61, so that when the full manifold pressure $P_L$ is effective on the primary pressure side 106 of the second diaphragm 101 during acceleration of the engine the setting member 63 is moved downwardly via the push rod 107. When the pressure in the chamber 102, lying between the diaphragms 61 and 101, becomes equal to $P_L$, that is, it equalizes with the pressure in the chamber 103, the larger diaphragm 101 is ineffective and the smaller diaphragm 61 acts alone. In this exemplary embodiment, in contrast to the exemplary embodiment according to FIG. 2, the pressure acting upon the primary pressure side 96' of the diaphragm 61 in the chamber 102 is continuously influenced by the flow throttle 41 of the delay element 38. Under certain operational conditions, this can be advantageous. If, however, the throttling effect is not desired, for example, during a deceleration of the engine, i.e. during a decrease of the manifold air pressure, then, similar to what was done in FIG. 2 between chambers 92 and 82, a check valve (not shown) can be inserted here in the connection between the manifold pressure line 29 and the chamber 102, making possible an undisturbed pressure decrease in the chamber 102.

The exemplary embodiment according to FIG. 4 shows the same basic construction as that according to FIG. 2; however, in this case, the control medium is the exhaust gas of the engine whose pressure increases more rapidly than does the manifold air pressure during an acceleration of the engine. For this reason the chambers 112 and 82 are separated from one another and manifold air streaming into the chamber 82 through the manifold pressure line 29 acts upon the diaphragm 61. The diaphragm 61 moves the setting member 63 in the same manner as was done in the exemplary embodiment according to FIG. 2. To this motion of the setting member 63, which is controlled by the diaphragm 61 and hence by the manifold air pressure $P_L$, there is added the position change $s$ produced by the supplementary control unit 118 when, during an acceleration of the engine, a differential pressure $\Delta P(\Delta P = P_{AB} - P_{AV})$ acts on the side 110 of the diaphragm 109 in the chambers 114 and 112. This pressure difference urges the push rod 108 downwardly just as occurred in the previously described examples, and a supplementary position change of the setting member 63 is thereby effected.

In the previously described example according to FIG. 1, the surface area of the counter pressure side 37 of the diaphragm 35 which is acted upon by the control medium counter pressure $P_{LV}$, is smaller than the surface area of the primary pressure side 36 of this same diaphragm which is acted upon by the full control pressure, the difference being equal to the cross section of the connecting rod 46. From this difference derives a delayed reponse threshold of the supplementary control unit 12 which is caused by the pre-tension Pv2 of the return spring 54. This influence of the connecting rod 46 is completely eliminated in the two exemplary embodiments according to FIGS. 5 and 6.

In the fifth exemplary embodiment according to FIG. 5, the full surface area of both the diaphragms 121 and 122 is effected at constant speed and since both diaphragms are of equal size, no differential force can occur. In other respects, the supplementary control unit 120 operates in the same way as the control unit 12 of FIG. 1.

In the sixth exemplary embodiment according to FIG. 6, the effect of the supplementary control unit 130 on the setting member 49 is the same as that described for FIGS. 5 and 1. Because the effective surface areas of the sides 137 and 134 of the two diaphragms 131 and 132, which are acted upon by manifold air pressure, are diminished by the same amount, i.e. by an area equal to the cross sectional area of the connecting rod 133, no net force due to unequal effective surface areas can develop. The differential pressure vanishes whenever, during constant speed operation, manifold air counterpressure $P_{LV}$ acting on the side 137 of the diaphragm 131 has become equal to the manifold pressure $P_L$ acting on the side 134 of the membrane 132.

The exemplary embodiment according to FIG. 7 is designed so that during a rapid acceleration of the engine, the entire surface area of the larger diaphragm 141 is acted upon and, via the connecting rod 143 and lever 144, the setting member 49 is displaced for the provision of an increased fuel supply quantity. During constant speed operation or during a slow acceleration of the engine, the pressure exerted on the diaphragm 142 approximates that exerted on the diaphragm 141, and only the differential surface area of the two diaphragms 141 and 142 is effective for moving the setting member 49. This arrangement has the advantage that the construction is simple and neat, that there are no guiding sleeves to be sealed and that the cross sectional area of the connecting rod 143 has no influence on the forces acting upon the membranes 141 and 142.

What is claimed is:

1. In a fuel control system for supercharged, fuel injected internal combustion engines employing exhaust gas turbo-chargers, comprising: a turbo-charged intake manifold pressure actuated first movable partition means; a setting member; and means connecting the setting member to said first partition means, said setting member being actuated by the motion of said first movable partition means and said means connecting the setting member to said first partition means for displacing said setting member in the direction of an increasing fuel supply quantity during a period of increasing turbo-charged intake manifold pressure, the improvement comprising: a supplementary pneumatic control unit having delayed feedback characteristics and including a second movable partition means, air line means positioned between the intake manifold and one side of said first movable partition means and further line means connected to one side of said second movable partition means for supplying a pneumatic control medium thereto, means for connecting said second partition means to said setting member, and both the one side of the first and the one side of the second partition means are pressure actuated by the fuel intake manifold pressure, i.e., the pneumatic control medium pressure, in the same working direction when viewing the movement of the setting member, a delay member connected to said control unit through which said control medium is supplied to the other side of said second movable partition means, by means of said control unit the position of said setting member is made to be additionally changeable, said second movable partition means being acted on by a differential pressure of the pneumatic control medium delivered through said connecting line means to the one side of said second movable partition means and through said delay member to the other side of said second movable partition means, where said pressure is a measure of the engine acceleration, whereby during periods of increasing pressure of the control medium, said second partition means and said means for connecting said second partition means to said setting member supplementarily displaces said setting member beyond the position set by said first movable partition means and in the direction of an increasing fuel supply quantity, and counter pressure means comprising said delay member for producing, during constant speed operation, a reversal of the supplementary displacement of said setting member to a zero value by the effect of an increasing counter pressure exerted by the control medium.

2. A fuel control system as defined in claim 1, wherein the instantaneous difference between the turbo-charged intake manifold pressure which increases during engine acceleration and the counter pressure which increases at a lower rate due to said delay member, defines the magnitude of said differential pressure.

3. A fuel control system as defined in claim 2, wherein said second movable partition means includes a primary pressure surface and a counter pressure surface, wherein the supplementary displacement of said setting member is effected by said second movable position means, and wherein full manifold pressure acts on the primary pressure surface and as a result of said delay member a delayed increasing counter pressure derived from said manifold pressure acts on the counter pressure surface.

4. A fuel control system as defined in claim 3, further comprising a further return spring and a compensating spring, wherein the counter pressure side of said second movable partition means is loaded by said further return spring, and wherein its primary pressure side is loaded by said compensating spring, with the pre-tension of said compensating spring acting in opposition to the pre-tension of said return spring.

5. A fuel control system as defined in claim 3 wherein said means connected to said control unit and through which said control medium is communicated to said second movable partition means includes a supply channel leading to the chamber which is contiguous to said counter pressure side of said second movable partition means, and wherein said delay member is inserted in said supply channel, said delay member having a flow-throttle therein.

6. A fuel control system as defined in claim 1, wherein said first and second movable partition means are diaphragms, and wherein each of said connecting means includes a connecting rod and one arm of a two-armed lever, with the center of said lever being pivotably connected to said setting member, and with each said diaphragm being fastened to a respective one of the connecting rods.

7. A fuel control system as defined in claim 6, further comprising a housing for said first diaphragm, a support bushing threadedly engageable in said housing, and means mounted to said housing for adjusting the threaded engagement of said support bushing, wherein the pre-tension of said return spring loading said first diaphragm is changeable by means of said support bushing, and wherein said support bushing serves as a guide-sleeve for the connecting rod of said first diaphragm.

8. A fuel control system as defined in claim 6, wherein each of said diaphragms includes a primary pressure surface and a counter pressure surface, said diaphragms defining four separate chambers of which the two chambers which are contiguous to the primary pressure surfaces of said two diaphragms experience the full manifold air pressure, the chamber which is contiguous to the counter pressure surface of the first diaphragm experiences ambient air pressure, and the chamber contiguous to the counter pressure surface of the second diaphragm experiences the increasing counter pressure delayed by said delay member.

9. A fuel control system as defined in claim 1, further comprising a connecting rod, and wherein said movable partition means are formed to include two coaxial and sequentially disposed diaphragms, with said first diaphragm being fixedly connected with said setting member by said connecting means and with said second diaphragm acting on said setting member through the action of said connecting rod.

10. A fuel control system as defined in claim 9, wherein said return spring of said first diaphragm is mounted to serve also as the return spring of said second diaphragm.

11. A fuel control system as defined in claim 1, wherein said second movable partition means includes a primary pressure surface and a counter pressure surface, and wherein said pneumatic control medium is engine exhaust gas, with said primary pressure surface being acted on by the full exhaust gas pressure for effecting the supplementary position change of said setting member, and with said counter pressure surface being acted upon by a delayed increasing exhaust gas counter pressure which is delayed by said delay member.

12. In a fuel control system for supercharged, fuel injected internal combustion engines employing exhaust gas turbo-chargers, comprising: a pressure actuated first movable partition means; at least one return spring opposing the motion of said first partition means; a setting member; and means connecting the setting member to said first partition means, said setting member being actuated by the motion of said partition means whereby the operating region of a fuel quantity adjustment member of the injection system of the engine is changeable in the direction of increasing supply quantity during a period of increasing intake manifold pressure, the improvement comprising: a supplementary pneumatic control unit having delayed feedback characteristics and including a second movable partition means, means connected to one side of said first movable partition means and said second movable partition means for supplying a pressurized medium thereto, means for connecting said second partition means to said setting member, a delay member connected to said control unit through which a pressurized medium is supplied to the other side of said second movable partition means, and a connecting rod, by means of said control unit the position of said setting member is made to be additionally changeable, said second movable partition means being acted on by a differential pressure of a pneumatic control medium delivered through said connecting means to the one side of said second movable partition means and through said delay member the other side of said second movable partition means, wherein the pneumatic control medium is engine intake manifold air whose pressure is a measure of the engine acceleration, wherein the instantaneous difference between the intake manifold pressure which increases during engine acceleration and the counter pressure which increases at a lower rate due to said delay member defines the magnitude of said differential pressure, wherein said movable partition means are formed to include two coaxial sequentially disposed and oppositely acting diaphragms of different diameter, said diaphragms being connected together by said connecting rod which in turn is connected to said setting member by said connecting means, wherein the space surrounding said connecting rod and lying between said two diaphragms is exposed to ambient air pressure, and wherein the larger of said two diaphragms is exposed to the full manifold pressure whereas the smaller of said two diaphragms is exposed to the delayed increasing manifold counter pressure so that during constant engine rpm only the differential area of said two diaphragms is effective, whereby during periods of increasing pressure of the control medium, said setting member tends to be supplementarily displaced beyond the position set by said first movable partition means and in the direction of an increasing fuel supply quantity, and whereby during constant speed operation the supplementary displacement is reversible to a zero value by the effect of an increasing counter pressure exerted by the control medium, said counter pressure being increased in a delayed manner by said delay member.

13. In a fuel control system for supercharged, fuel injected internal combustion engines employing exhaust gas turbo-chargers, comprising: a pressure actuated first movable partition means; at least one return spring opposing the motion of said first partition means, a setting member; and means connecting the setting member to said first partition means, said setting member being actuated by the motion of said partition means whereby the operating region of a fuel quantity adjustment member of the injection system of the engine is changeable in the direction of increasing supply quantity during a period of increasing intake manifold pressure, the improvement comprising: a supplementary pneumatic control unit having delayed feedback characteristics and including a second movable partition means, means connected to one side of said first movable partition means and said second movable partition means for supplying a pressurized medium thereto, means for connecting said second partition means to said setting member, a delay member connected to said control unit through which a pressurized medium is supplied to the other side of said second movable partition means, and a connecting rod, by means of said control unit the position of said setting member is made to be additionally changeable, said second movable partition means being acted on by a differential pressure of a pneumatic control medium delivered through said connecting means to the one side of said second movable partition means and through said delay member the other side of said second movable partition means, wherein the pneumatic control medium is engine intake manifold air whose pressure is a measure of the engine acceleration, wherein the instantaneous difference between the intake manifold pressure which increases during engine acceleration and the counter pressure which increases at a lower rate due to said delay member defines the magnitude of said differential pressure, wherein said second movable partition means includes a primary pressure surface and a counter pressure surface, wherein the supplementary displacement of said setting member is effected by said second movable partition means, wherein full manifold pressure acts on the primary pressure surface and as a result of said delay member a delayed increasing counter pressure derived from said manifold pressure acts on the counter pressure surface, wherein said second movable partition means is formed to include two coaxial, sequentially disposed diaphragms of equal diameter, said diaphragms being connected together by said connecting rod which in turn is pivotably connected to said setting member by said connecting means, and wherein the primary pressure side of one of said two diaphragms is exposed to the full manifold air pressure and the corresponding primary pressure side of the second of said two diaphragms serves as the counter pressure side of said second movable partition means and is exposed to the delayed increasing manifold air counter pressure, whereby during periods of increasing pressure of the control medium, said setting member tends to be supplementarily displaced beyond the position set by said first movable partition means and in the direction of an increasing fuel supply quantity, and whereby during constant speed operation the supplementary displacement is reversible to a zero value by the effect of an increasing counter pressure exerted by the control medium, said counter pressure being increased in a delayed manner by said delay member.

14. In a fuel control system for supercharged, fuel injected internal combustion engines employing exhaust gas turbo-chargers, comprising: a pressure actuated first movable partition means; at least one return spring opposing the motion of said first partition means; a setting member; and means connecting the setting member to said first partition means; said setting member being actuated by the motion of said partition means whereby the operating region of a fuel quantity adjustment member of the injection system of the engine is changeable in the direction of increasing supply quantity during a period of increasing intake manifold pressure, the improvement comprising: a supplementary pneumatic control unit having delayed feedback characteristics and including a second movable partition means, means connected to one side of said first movable partition means and said second movable partition means for supplying a pressurized medium thereto, means for connecting said second partition means to said setting member, a delay member connectedd to said control unit through which a pressurized medium is supplied to the other side of said second movable partition means, and a check-valve mounted parallel to said flow-throttle, by means of said control unit the position of said setting member is made to be additionally changeable, said second movable partition means being acted on by a differential pressure of a pneumatic control medium delivered through said connecting means to the one side of said second movable partition means and through said delay member the other side of said second movable partition means, wherein the pneumatic control medium is engine intake manifold air whose pressure is a measure of the engine acdeleration, wherein the instantaneous difference between the intake manifold pressure which increases during engine acceleration and the counter pressure which increases at a lower rate due to said delay member defines the magnitude of said differential pressure, wherein said second movable partition means includes a primary pressure surface and a counter pressure surface, wherein the supplementary displacement of said setting member is effected by said second movable partition means, wherein full manifold pressure acts on the primary pressure surface and as a result of said delay member a delayed increasing counter pressure derived from said manifold pressure acts on the counter pressure surface, wherein said means connected to said control unit and through which said control medium is communicated to said second movable partition means includes a supply channel leading to the chamber which is contiguous to said counter pressure side of said second movable partition means, wherein said delay member is inserted in said supply channel, said delay member having a flow-throttle therein, and wherein said check-valve serves to insure an unthrottled return flow of said control medium from the chamber contiguous to said counter pressure side of said second movable partition means, whereby during periods of increasing pressure of the control medium, said setting member tends to be supplementarily displaced beyond the position set by said first movable partition means and in the direction of an increasing fuel supply quantity, and whereby during constant speed operation the supplementary displacement is reversible to a zero value by the effect of an increasing counter pressure exerted by the control medium, said counter pressure being increased in a delayed manner by said delay member.

15. In a fuel control system for supercharged, fuel injected internal combustion engines employing exhaust gas turbo-chargers, comprising: a pressure actuated first movable partition means; at least one return spring opposing the motion of said first partition means; a setting member; and means connecting the setting member to said first partition means, said setting member being actuated by the motion of said partition means whereby the operating region of a fuel quantity adjustment member of the injection system of the engine is changeable in the direction of increasing supply quantity during a period of increasing intake manifold pressure, the improvement comprising: a supplementary pneumatic control unit having delayed feedback characteristics and including a second movable partition means, means connected to one side of said first movable partition means and said second movable partition means for supplying a pressurized medium thereto, means for connecting said second partition means to said setting member, a delay member connected to said control unit through which a pressurized medium is supplied to the other side of said second movable partition means and a connecting rod, by means of said control unit the position of said setting member is made to be additionally changeable, said second movable partition means being acted on by a differential pressure of a pneumatic control medium delivered through said connecting means to the one side of said second movable partition means and through said delay member the other side of said second movable partition means, where said pressure is a measure of the engine acceleration, wherein said movable partition means are formed to include two coaxial and sequentially disposed diaphragms, with said first diaphragm being fixedly connected with said setting member by said connecting means and with said second diaphragm acting on said setting member through the action of said connecting rod, wherein each said diaphragm includes a primary pressure surface and a counter pressure surface, and wherein said second diaphragm is larger than said first diaphragm, with both said diaphragms defining together three separate chambers of which the chamber contiguous to the primary pressure surface of said second diaphragm experiences the full manifold air pressure, the middle chamber which is contiguous simultaneously to the counter pressure surface of said second diaphragm and the primary pressure surface of said first diaphragm experiences the delayed increasing manifold counter pressure, and the chamber which is contiguous to the counter pressure surface of said first diaphragm experiences ambient air pressure, whereby during periods of increasing pressure of the control medium, said setting member tends to be supplementarily displaced beyond the position set by said first movable partition means and in the direction of an increasing fuel supply quantity, and whereby during constant speed operation the supplementary displacement is reversible to a zero value by the effect of an increasing counter pressure exerted by the control medium, said counter pressure being increased in a delayed manner by said delay member.

16. A fuel control system as defined in claim 15, wherein said return-spring of said first diaphragm is mounted to serve also as the return spring of said second diaphragm.

* * * * *